US008464563B2

(12) United States Patent
Perez et al.

(10) Patent No.: US 8,464,563 B2
(45) Date of Patent: Jun. 18, 2013

(54) BI-DIRECTIONAL ADJUSTABLE BENEFIT DENIAL SAFER/KEEPER

(75) Inventors: Sergio M. Perez, Lake Worth, FL (US); Karen E. Bellum-Bomber, Boca Raton, FL (US)

(73) Assignee: Tyco Fire & Security GmbH, Neuhausan am Rheinfall (CH)

( * ) Notice: Subject to any disclaimer, the term of this patent is extended or adjusted under 35 U.S.C. 154(b) by 100 days.

(21) Appl. No.: 12/898,177

(22) Filed: Oct. 5, 2010

(65) Prior Publication Data

US 2012/0079858 A1 Apr. 5, 2012

(51) Int. Cl.
*E05B 73/00* (2006.01)

(52) U.S. Cl.
USPC ..... 70/57.1; 70/19; 70/58; 70/276; 70/461; 206/308.2; 206/387.11; 340/572.9

(58) Field of Classification Search
USPC ..... 70/14, 18, 19, 225, 226, 57.1, 58, 70/461, 57, 63, 276, 413; 340/572.8, 572.9; 248/551; 188/32; 211/43, 175, 26.2; 206/308.2, 206/387.11, 807; 224/456, 461, 558, 929, 224/930
See application file for complete search history.

(56) References Cited

U.S. PATENT DOCUMENTS

| | | | | | |
|---|---|---|---|---|---|
| 555,829 | A * | 3/1896 | Rogers | 24/17 A |
| 3,410,122 | A * | 11/1968 | Moses | 70/58 |
| 3,695,071 | A * | 10/1972 | West | 70/225 |
| 4,097,012 | A * | 6/1978 | McIntyre | 248/674 |
| 4,649,724 | A * | 3/1987 | Raine | 70/226 |
| 4,833,442 | A * | 5/1989 | Von Heck | 340/427 |
| 5,119,651 | A * | 6/1992 | Yang | 70/52 |
| 5,140,836 | A * | 8/1992 | Hogan et al. | 70/57.1 |
| 5,267,458 | A * | 12/1993 | Heh | 70/238 |
| 5,437,172 | A * | 8/1995 | Lamy et al. | 70/57.1 |
| 5,645,261 | A * | 7/1997 | Glynn | 248/551 |
| 5,715,711 | A * | 2/1998 | Jennison | 70/226 |
| 6,016,674 | A * | 1/2000 | Yang | 70/209 |
| 6,116,062 | A * | 9/2000 | Markegard et al. | 70/19 |
| 6,237,375 | B1 | 5/2001 | Wymer | |
| 7,492,263 | B2 * | 2/2009 | Marsilio et al. | 340/572.1 |

FOREIGN PATENT DOCUMENTS

| | | |
|---|---|---|
| EP | 1087083 A1 | 3/2001 |
| EP | 1970511 A1 | 9/2008 |

OTHER PUBLICATIONS

EPO International Search Report dated Jan. 30, 2012 for corresponding appln PCT/US11/01696.

* cited by examiner

*Primary Examiner* — Lloyd Gall
(74) *Attorney, Agent, or Firm* — Alan M. Weisberg; Christopher & Weisberg, P.A.

(57) ABSTRACT

A size-adjustable apparatus for a securing a product in order to prevent theft of that product. The apparatus includes an adjustable housing, the housing having a first arm, a second arm, and a third arm. The first arm is adapted to move in a first direction and a second direction with respect to the third arm and the second arm is adapted to move in a third direction and a fourth direction with respect to the third arm, where the first direction is opposite the second direction and the third direction is opposite the fourth direction. The apparatus also includes a lock to retain the adjustable housing in a desired position. The result is a housing that can dynamically change its dimensions by movement of the first arm in a first and second direction and by movement of the second arm in a third and fourth direction.

18 Claims, 9 Drawing Sheets

SECTION A-A

BI-DIRECTIONAL ADJUSTABLE BENEFIT DENIAL SAFER/KEEPER

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to security devices and more specifically to an apparatus and method for preventing the theft of products of different sizes using a secure, adjustable product protection device.

BACKGROUND OF THE INVENTION

Shoplifting continues to be a major concern of retail stores. Particularly with regard to electronic and other high-priced items, retailers continue to try and find effective product theft deterrents. However, wrongdoers are constantly coming up with methods of circumventing the latest theft-prevention devices offered by retailers. For example, some retailers have introduced theft deterrent devices such as cables, also known as "spider wraps" that are wrapped around a product and coupled to an electronic sensor that sounds an alarm when there is an attempt to remove the product from the wrap before the product has been purchased and the sensor deactivated. These devices are cumbersome to use and may not be able to be secured to packaging having an odd shape. Other "safer" or "keeper" devices house the product but require additional labor for their application and removal. Retailers are seeking an easier solution that can effectively display their items for sale, prevent the unauthorized removal of items within the package, and decreases in-store labor for the application and removal of these protective devices.

Retailers have turned toward wrapping their products with material containing an audible and/or visual alarm. The wrap is designed to initiate an alarm when an unauthorized removal is attempted. However, wraps often detract from the appeal of the product thus resulting in possible loss of sales. Additionally, wraps are cumbersome to use, hard to physically manage, difficult to attach to items, and difficult to remove at the point-of-sale.

"Safer" or "keeper" products are devices that house items in order to provide a visual deterrent to would-be shoplifters. The concept of a safer is to allow a customer to view the product therein, but to provide enough protection so that a thief cannot access the product. Safers are typically designed for small, packaged goods. There are two types of safers, fixed safers and adjustable safers. Although adjustable safers allow for size adjustments in order to accommodate different-sized products, they do so in only a single direction. In other words, a typical safer can be height adjusted but cannot be adjusted in width. Others can be adjusted in width but cannot be adjusted in height. Thus, many safers that might accommodate small, rectangular products, cannot be used for larger or square-shaped products. Therefore, retailers end up with many different-sized and different-shaped safers in their inventory. Further, since safers only adjust in single direction, if the item is not held tightly within the safer e.g., the store employee selects the wrong size safer, the item can be removed and stolen.

Currently, safers may require a special detaching device at the Point of Sale ("POS"). Retailers are seeking a single detacher at the POS to decrease confusion by employees and to speed up customer check-out.

In addition to wraps and safers that are adjustable in only one direction, other retailers use the old-fashioned method of preventing theft of their expensive products, namely, locking these products in a protective case behind a checkout counter. Unfortunately, this method requires a sales associate to access the items that are protected by a lock and because of their location behind the counter or locked in a cabinet, render the item inaccessible to a prospective customer. Placing items behind lock and key in this fashion requires store personnel to access the item for the customer. If there is no store employee available to access the items, the item typically does not get sold, thus resulting in high inventory levels for the retailer, decreased revenue, and unsatisfied customers.

It is therefore desirable to provide an adjustable product protection device that can be adapted for different sized and shaped products, that does not obscure the manufacturer's logo and product description, provides a sufficient deterrent for would-be shoplifters, can be adjusted in many directions and is easy for store employees to remove at the POS when a product is being legitimately purchased.

SUMMARY OF THE INVENTION

The present invention advantageously provides a method and apparatus for securing a product in order to prevent theft of that product, where the housing is adjustable in order to secure products of different heights and lengths.

In one aspect of the invention, a product protection apparatus is provided. The apparatus includes an adjustable housing, the housing being adjustable in a first direction, a second direction, a third direction and a fourth direction, the first direction opposite the second direction, and the third direction opposite the fourth direction. The apparatus also includes a lock to retain the adjustable housing in a desired position.

In another aspect, the invention provides a product protection apparatus that includes an adjustable housing, the housing comprising a first arm, a second arm, and a third arm. The first arm is adapted to move in a first direction and a second direction with respect to the third arm and the second arm is adapted to move in a third direction and a fourth direction with respect to the third arm, the first direction being opposite the second direction, and the third direction being opposite the fourth direction. The apparatus also includes a lock to retain the adjustable housing in a desired position.

In another aspect of the invention, a method of securing a product within an adjustable housing is provided. The method includes inserting a product within an adjustable housing, the housing adjustable in a first direction, a second direction, a third direction and a fourth direction, the first direction being opposite the second direction, and the third direction being opposite the fourth direction, adjusting the housing in one or more of the first direction, the second direction, the third direction and the fourth direction in order to secure the product, and using a lock to maintain the housing in the adjusted position. The lock includes a latch having a first plane and a second plane in which the second plane is different from the first plane and each of the first plane and the second plane having a plurality of teeth. The first plane is substantially parallel to the second plane.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
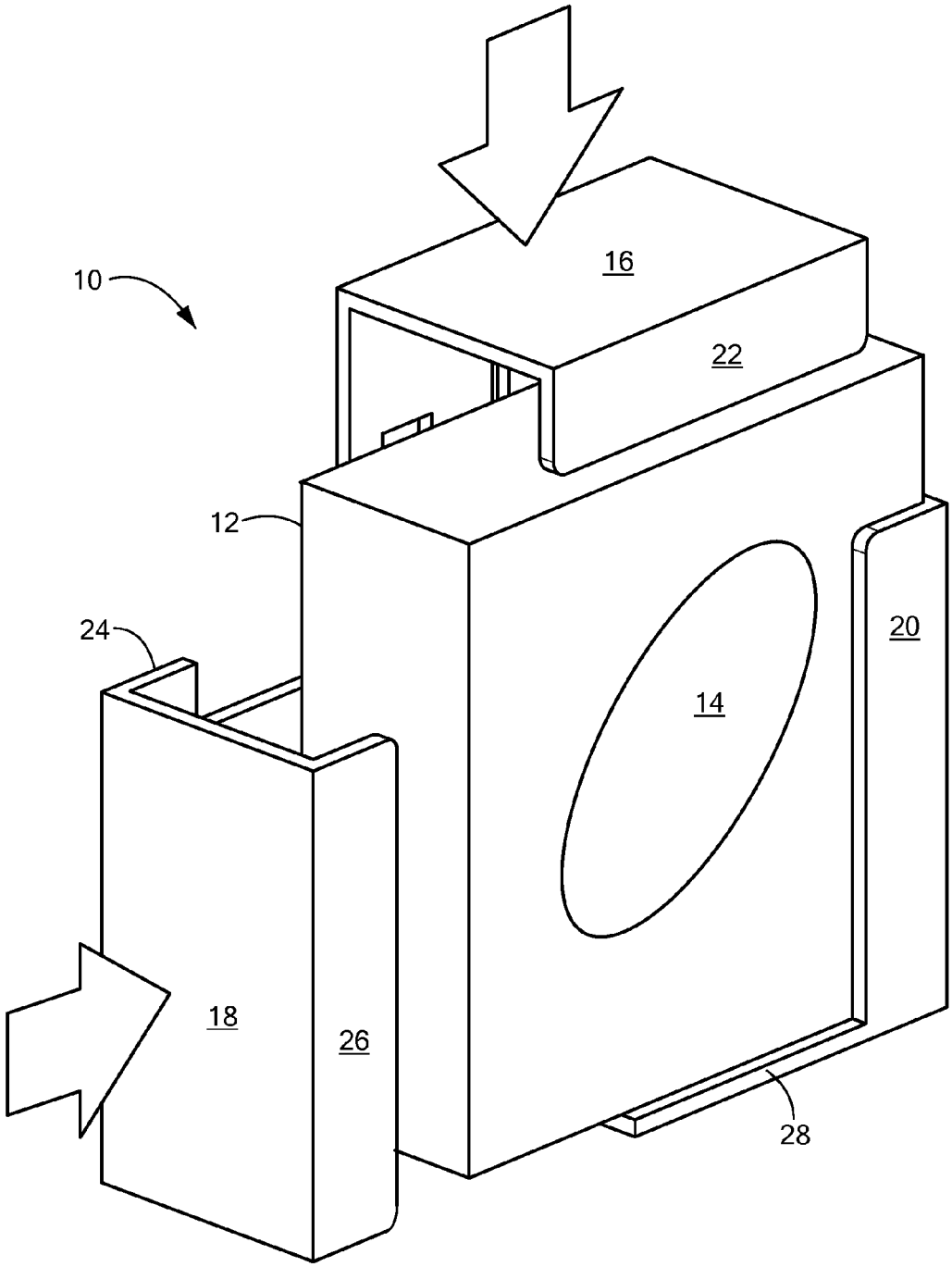
FIG. 1 is a front perspective view of an adjustable product protection device constructed in accordance with the principles of the present invention.

Before describing in detail exemplary embodiments that are in accordance with the present invention, it is noted that the embodiments reside primarily in combinations of apparatus components and processing steps related to implementing an apparatus and method for protecting products of different sizes and shapes by providing an adjustable housing, the housing being adjustable in a first direction, a second direction, a third direction and a fourth direction, the first direction opposite the second direction, and the third direction opposite the fourth direction. The apparatus also includes a lock to retain the adjustable housing in a desired position. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides an apparatus and method for providing a size-adjustable housing for a product in order to prevent theft of that product while still allowing indicia on the product to be viewed. The apparatus of the present invention includes a receptacle to house the product, where the receptacle can vary in size in multiple directions in order to accommodate differently products having differing height as well as differing lengths. The receptacle includes three arms, two of the arms movable with respect to the third, stationary arm. A first arm moves vertically with respect to the stationary arm while a second arm moves horizontally with respect to the stationary arm. The result is a receptacle that can dynamically change its dimensions by movement of the first and second arms. The receptacle can house products of varying height by moving the first arm and can also accommodate products that are wider or narrower by moving the second arm. Advantageously, the three arms of the receptacle are arranged such that the front of the product remains uncovered in order to show the substantial front of the product, its name or identifying logo, or other indicia.

The present disclosure will be understood more fully from the detailed description given below and from the accompanying drawings of particular embodiments of the invention which, however, should not be taken to limit the invention to a specific embodiment but are for explanatory purposes.

Referring now to the drawing figures in which like reference designators refer to like elements, there is shown in FIG. 1 an exemplary configuration of a product protection safer/keeper apparatus 10 according to an embodiment of the present invention. Apparatus 10 includes a receptacle that receives a product 12. Product 12 may be any type of product that a store owner wants to protect from theft. While the invention is not limited to the type of product 12 that apparatus 10 can be used to protect, many store owners are particularly concerned with the theft of higher priced, electronic items such as, for example, compact discs, DVDs, portable audio players such as iPODS and MP3 players, cellular phones and the like. Apparatus 10 can also be used to protect smaller, but easy to steal items like beauty supply or office supply items. In addition, product 12 can be a larger electronic product such as portable radios, alarm clocks, and DVD players. Of course, the invention is not limited to such and the above are merely examples to illustrate the potential uses for the subject invention. Advantageously, apparatus 10 can be adjusted in multiple directions and in two planes of direction in order to accommodate products of different sizes and shapes, thereby eliminating the need for multiple protection products of different dimensions.

Further, apparatus 10 does not mask the front packaging of product 12 as shown in FIG. 1. Indicia 14 can be clearly viewed when product 12 is within the housing of apparatus 10. This pleases not only the store owners and the customers, but also the product's manufacturer. In one embodiment, the housing of apparatus 10 includes a first arm 16, a second arm 18, and a third arm 20. First arm 16 is movable a first and second direction, where the second direction is opposite the first direction. Thus, in one embodiment, the first direction is upward and the second direction is downward in the opposite direction. Thus, first arm 16 can be raised in order to accommodate a taller product 12. Once product 12 is inserted, first arm 16 can then be lowered to retain and secure product 12.

Second arm 18 is movable in a third direction and fourth direction where the fourth direction is opposite the third direction. Thus, in one embodiment, the third direction is horizontally to one side thus opening the receptacle in order to receive product 12. Once product 12 has been inserted, second arm 18 can be closed in a fourth direction that is opposite the third direction. Second arm 18 can be opened to accommodate a longer product and then closed once product 12 has been inserted. Therefore, it is within the scope of the invention for the first, second, third and fourth directions to be in any direction provided the second direction is opposite the first direction (e.g., raising and lowering first arm 16) and the fourth direction is opposite the third direction (e.g., opening and closing second arm 18).

In one embodiment, first arm 16 includes a flap 22 and second arm 18 includes left flap 24 and right flap 26. Third arm 20 includes lower edge 28. Left flap 24, right flap 26 and lower edge 28 help to more securely retain product 12. While third arm 20 does not move, first arm 16 and second arm 18 are movable with respect to third arm 20. First arm 16, second arm 18 and third arm 20 form a housing for retaining product 12. Once product 12 has been inserted within the housing created by first arm 16, second arm 18 and third arm 20 as described above, first arm 16 can be adjusted, e.g., raised and/or lowered, and second arm 18 can be adjusted, e.g., opened and/or closed, in order to secure product 12 snugly within the housing formed by the three arms. The invention is not limited to what order the arms are opened and closed. For example, first arm 16 can be raised and/or lowered to adjust for the product's height and then second arm 18 can be opened and/or closed to adjust for the product's length, or vice versa. First arm 16 and second arm 18 can also be adjusted simultaneously.

Figure 2:
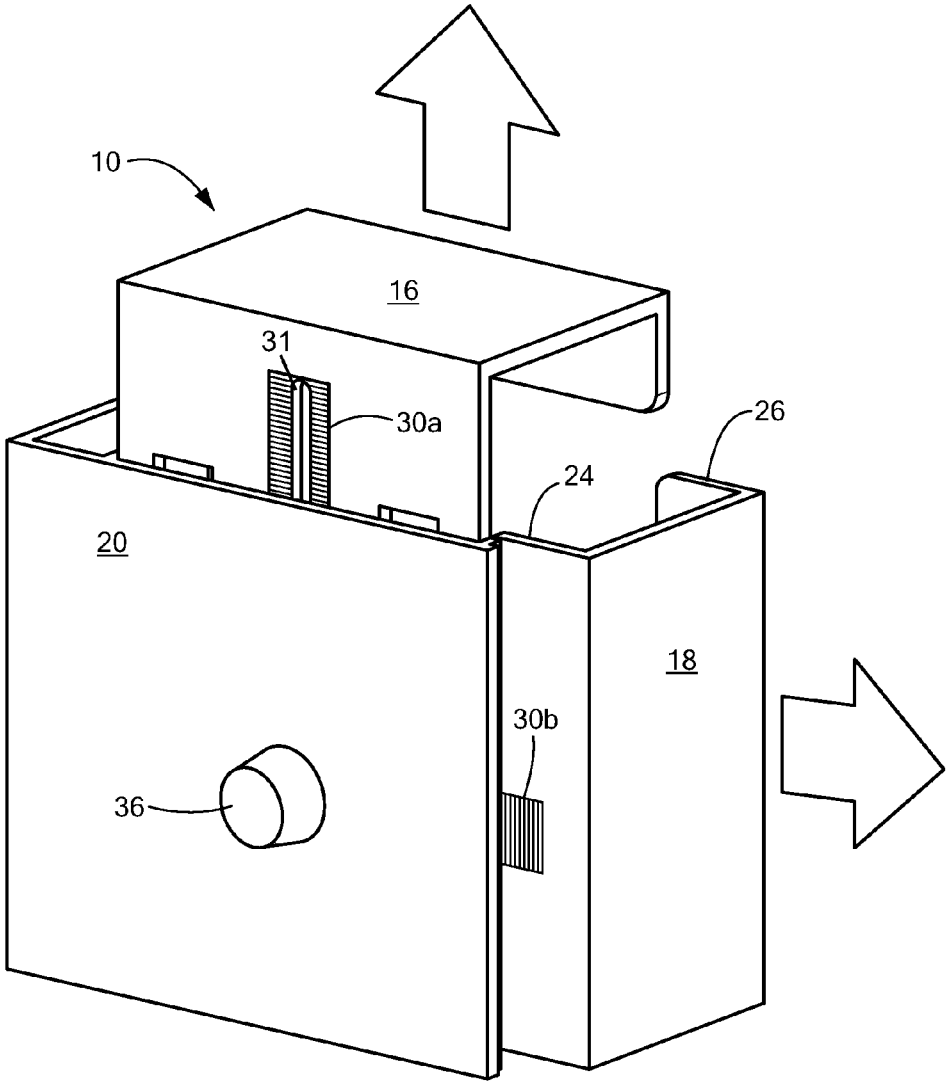
FIG. 2 is a rear perspective view of the adjustable product protection device of FIG. 1.

FIG. 2 is a rear view of apparatus 10 without product 12 and with first arm 16 and second arm 18 raised and open, respectively. Partially seen in FIG. 2 is a bidirectional track (more clearly shown in FIG. 5 and FIG. 8) having a vertical component 30*a* and slot 31 situated on first arm 16 and a horizontal component 30*b* situated on second arm 18. Both vertical component 30*a* and horizontal component 30*b* (collectively referred to as "bidirectional track 30") interacts with a lock 36 situated on third arm 20. As will be described in greater detail below, bidirectional track 30 allows for the movement of first arm 16 in a first and a second direction (e.g., a substantially vertical direction) to accommodate products 12 of different heights, and for the movement of second arm 18 in a third and fourth direction (e.g., a substantially horizontal direction) to accommodate products of different lengths. Lock 36 is also used to lock the arms in a desired position and prevent further movement of first arm 16 and second arm 18 once product 12 has been inserted within apparatus 10, or when, for example, apparatus 10 is in storage to prevent unwanted movement of the arms.

Figure 3:
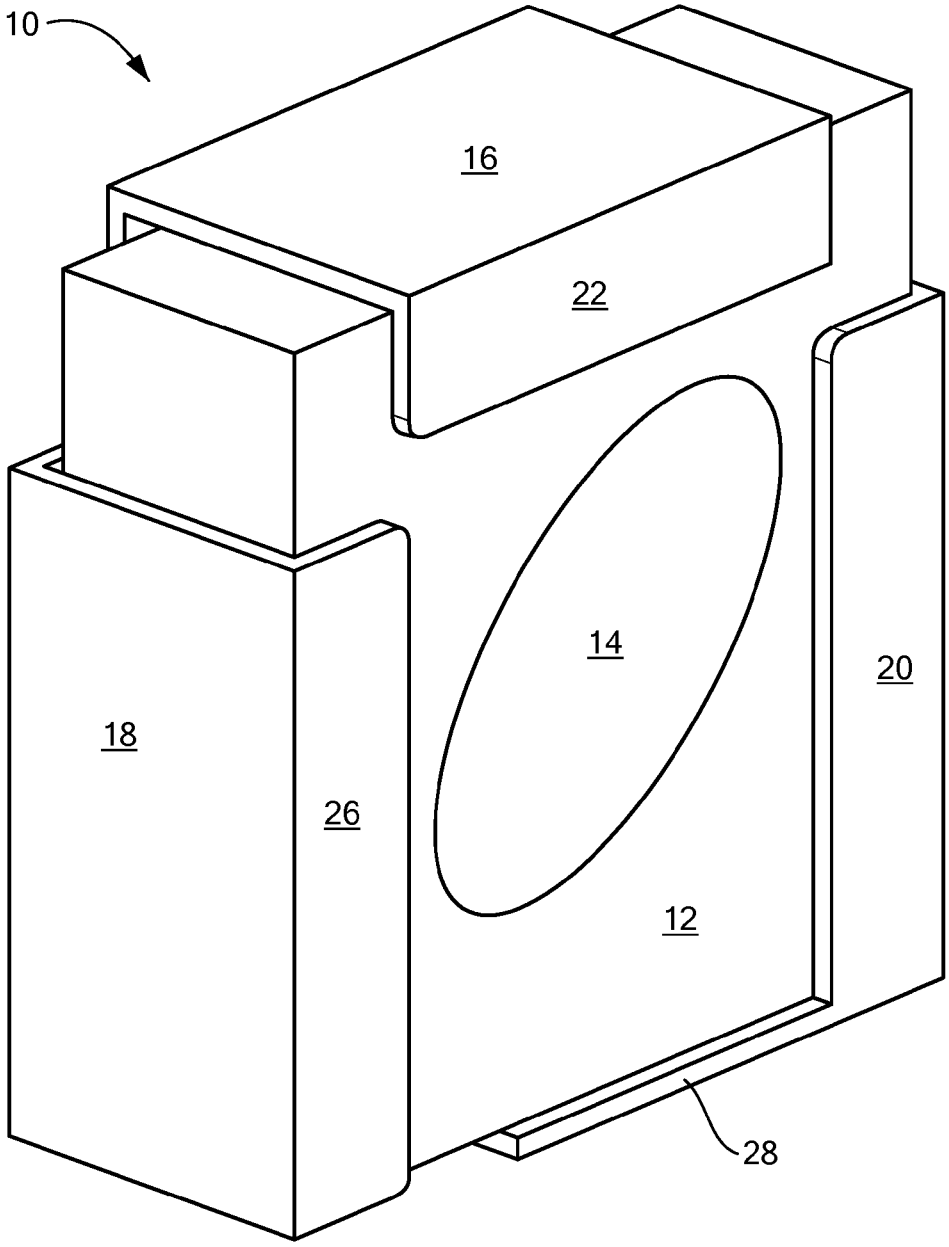
FIG. 3 is a front perspective view of the adjustable product protection device of FIG. 1 with a product contained therein.

FIG. 3 depicts apparatus 10 after first arm 16 and second arm 18 have been adjusted to receive product 12. In this closed configuration, apparatus 10 houses product 12 in a secure fashion without masking the front of the packaging of product 12 thus revealing any indicia 14 appearing on the front of product 12. As will be discussed in greater detail below, a product identification device such as an electronic article surveillance ("EAS") tag or radio frequency identification ("RFID") device may be affixed to apparatus 10. By affixing an EAS tag to apparatus 10, removal of product 12 within apparatus 10 without deactivation will sound an alarm. Further, inclusion of an RFID sensor within apparatus 10 can provide information to a store owner about the identity of product 12 contained within apparatus 10. Other alarming devices can be included within apparatus 10 including a sensor that will activate if product 12 is removed from apparatus 10.

Figure 4:
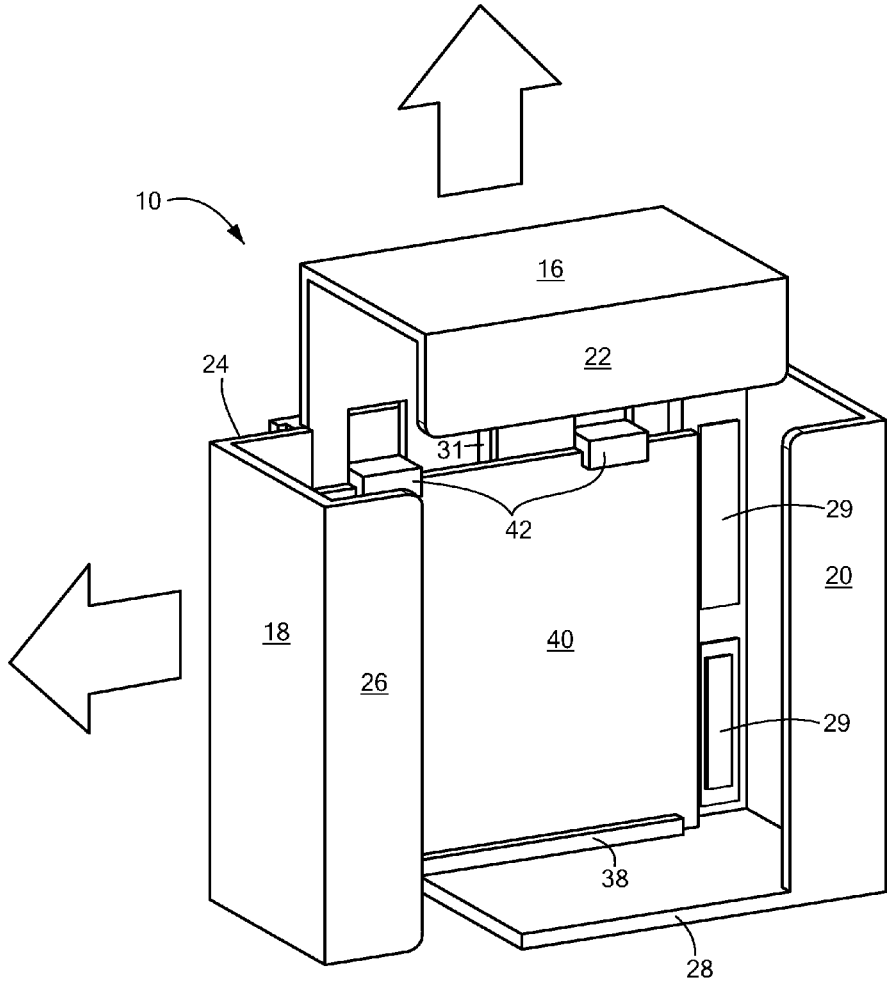
FIG. 4 is a front perspective view of the adjustable product protection device of FIG. 1 showing its adjustable components.

Referring to FIG. 4, apparatus 10 is shown without product 12. The arrows show the direction of movement of first arm 16 and second arm 18. In one embodiment, to facilitate the sliding motion of second arm 18 with respect to third arm 20, a lower track 38 receives a back section 40 of second arm 18. Back section 40 remains within track 38 as second arm 18 slides. Two upper tabs 42 may also be provided. Upper tabs 42 extend from third arm 20 to grasp the upper edge of back section 40 of second arm 18. Thus, an upper and lower channel is created to allow for the smooth and level movement of second arm 18 with respect to third arm 20.

Referring again to FIG. 4, in one embodiment, added elements 29 such as EAS tags and/or RFID elements may be affixed to apparatus 10. The elements 29 can be detected when apparatus 10 is brought within an interrogation zone or can transmit signals to a corresponding reader. The invention is not limited to the inclusion of only EAS and/or RFID elements 29 but may also include other technologies such as, P-mag, and J-mag, or the like, as well as combinations of any of these technologies.

Figure 5:
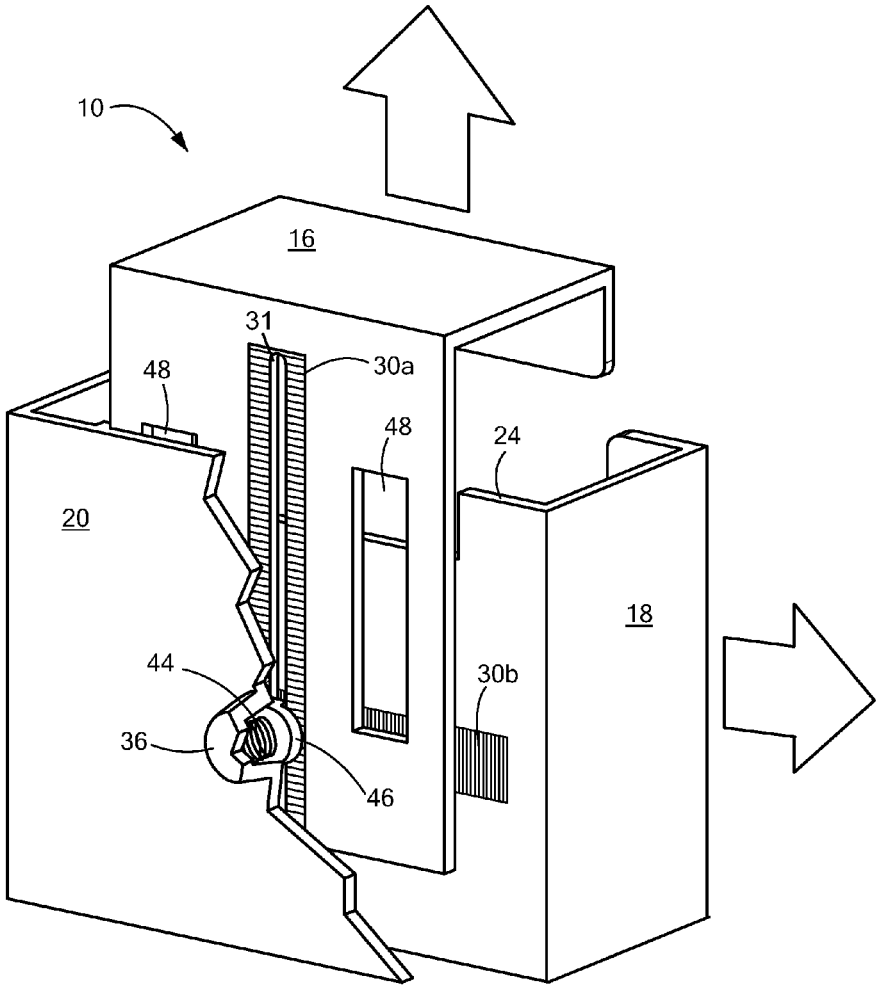
FIG. 5 is a rear perspective cutaway view of the adjustable product protection device of FIG. 1 showing the interlocking of the various adjustable components.

FIG. 5 is a cut away view of apparatus 10. In one embodiment, bidirectional track 30 includes a vertical component 30*a* and slot 31 on first arm 16 and horizontal component 30*b* on second arm 18. When lock 36 is in an unlocked position, first arm 16 and second arm 18 can slide along their respective tracks in order to accommodate product 12 that is to be protected. In one embodiment, lock 36 includes a spring 44 that is biased against a latch 46. Latch 46 is projected into slot 31 and the path of vertical component 30*a* and horizontal component 30*b* in order to prevent their movement, i.e., latch 46 of lock 36 removably engages second arm 18 through slot 31 and first arm 16 to retain the adjustable housing in a desired position. Vertical component 30*a* and horizontal component 30*b* each include a series of interlocking teeth that receive latch 46. When latch 46 is in an extended position due to the force upon it by spring 44, latch 46, which has a series of corresponding teeth, projects into the teeth of each track thus preventing the movement of first arm 16 along vertical component 30*a* and also prevents movement of second arm 18 along horizontal component 30*b*.

In another embodiment, the teeth on vertical component 30*a* and horizontal component 30*b* are angled. Thus, when spring 44 biases lock 36 toward the arms of apparatus 10 and latch 46 is projected within the path of first arm 16 and second arm 18, each arm is locked into position such that first arm 16 can only be moved downward and second arm 18 can only move inward to more securely retain product 12. In this embodiment, once the teeth of first arm 16 are engaged with latch 46, first arm 16 cannot be raised upward but can only be lowered due to the angle of the teeth in vertical component 30*a*. Similarly, once latch 46 engages the angled teeth of horizontal component 30*b*, second arm 18 can no longer be extended outward but can only be moved inward to more securely retain product 12. Thus, the teeth can be oriented to allow movement of the arms in one direction, e.g., to tighten apparatus 10, even when latch 46 is engaged with components 30*a* and 30*b*.

In one embodiment, latch 46 is made of a metallic material and a magnetic detacher applies a magnetic field upon latch 46. The magnetic field attracts latch 46, which forces the compression of spring 44. Latch 46 is then retracted from vertical component 30*a* and horizontal component 30*b*. This allows first arm 16 and second arm 18 to be adjusted and moved along their respective tracks. Latch 46 can be made to fully retract such that both vertical component 30*a* and horizontal component 30*b* are free to move. Windows 48 in first arm 16 receive tabs 42 (shown in FIG. 4) once the desired position of first arm 16 and second arm 18 is achieved. As shown in FIG. 4, tabs 42 rest upon horizontal section 40 of second arm 18.

Thus, in operation, when it is desired to adjust apparatus 10, lock 36 is released, which retracts latch 46. Spring 44 is initially biased in a forward or extended position, thus "locking" lock 36. Lock 36 is released by use of a magnetic detacher which attracts the metallic material of latch 46, compressing spring 44, and retracting latch 46 from within the path of vertical component 30*a* and horizontal component 30*b*. Other methods of unlocking lock 36 can also be used.

First arm 16 is raised in order to accommodate the height of product 12 that is to be placed within apparatus 10. Second arm 18 is moved outward in order to receive product 12. Product 12 can then be placed within the open receptacle formed by first arm 16, second arm 18 and third arm 20. First arm 16 is then moved down (if necessary) and second arm 18 is moved inward (if necessary) until a desired position is attained, with product 12 secured within apparatus 10. Once the desired position of first arm 16 and second arm 18 is attained, lock 36 is moved to a locked position, which extends spring 44 and projects latch 46 into vertical component 30*a* and horizontal component 30*b* of bidirectional track 30. This locks in the first arm 16 and second arm 18 and secures the product 12 within apparatus 10. Once product 12 is sold, apparatus 10 can be reused and resized to accommodate a differently sized and shaped product 12 using the method described above.

Figure 6:
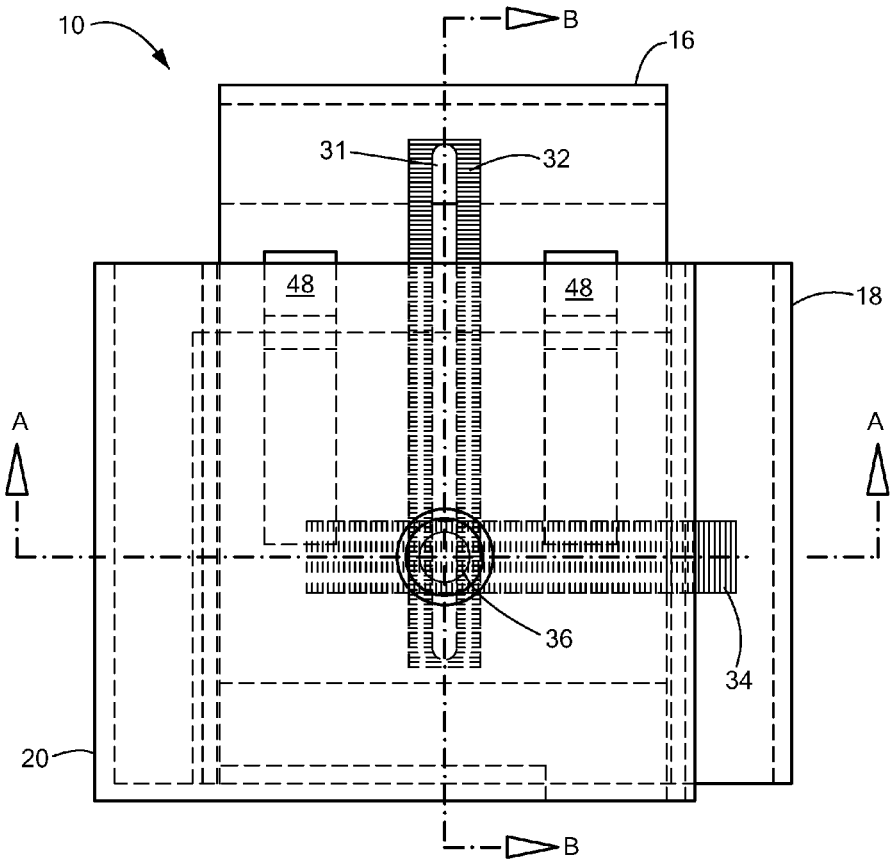
FIG. 6 is a rear transparent view of the adjustable product protection device of FIG. 1 showing the bidirectional track.

FIG. 6 is a cut away view of the back of apparatus 10 showing the interaction of all three arms. Advantageously, the present invention requires only a single connection point, e.g., where lock 36 contacts apparatus 10, to allow for multidirectional movement of the arms of apparatus 10. When in a locked position, lock 36 engages both the vertical component 30*a* and the horizontal component 30*b* of bidirectional track 30, i.e., lock 36 removably engages second arm 18 through slot 31 and first arm 16 to retain the adjustable housing in a desired position. By utilizing lock 36, latch 46 (shown in FIG. 5) can be manipulated to retract, thus allowing movement of first arm 16 and second arm 18 with respect to third arm 20, and to project into the path of each of the components of track 30 thus preventing further movement of first arm 16 and second arm 18. This "locks in" the position of first arm 16 and second arm 18 once product 12 has been inserted within apparatus 10. Bidirectional track 30 allows for apparatus 10 to be adjusted both to accommodate the height of product 12 (via movement of first arm 16) as well as the length of product 12 (via movement of second arm 18).

Figure 7:
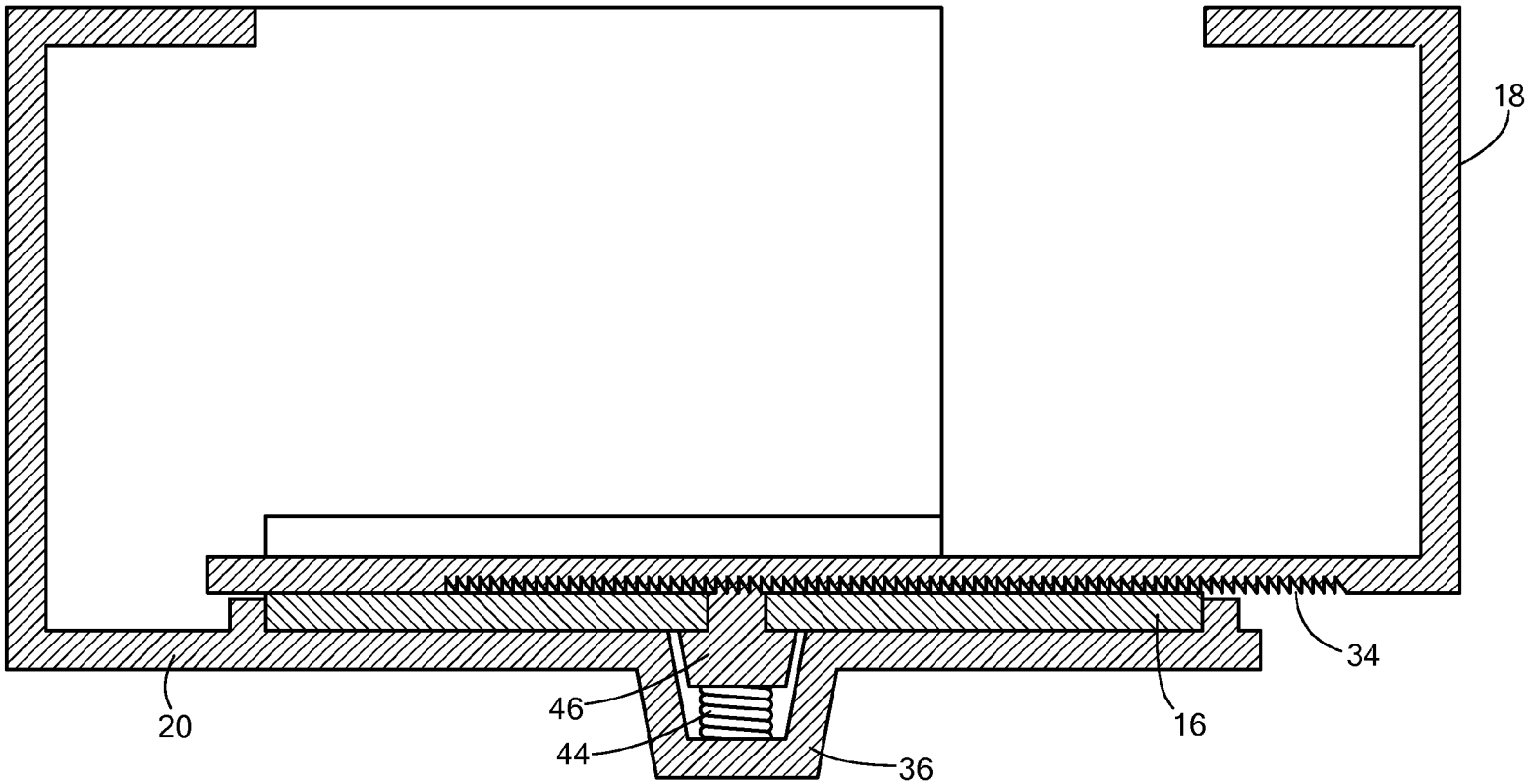
FIG. 7 is a section view of the adjustable product protection device taken through section A-A of FIG. 6.

FIG. 7 is a section view of apparatus 10, taken from section A-A in FIG. 6. Lock 36 is shown in a locked position, with latch 46 preventing the movement of first arm 16 and second arm 18. In one embodiment, spring 44 is biased in an extended position, projecting latch 46 into the path of vertical component 30*a* (not shown in FIG. 7) and horizontal component 30*b* of bidirectional track 30. When lock 36 is released, latch 46 is released from its engagement with bidirectional track 30 and spring 44 is compressed. This allows for first arm 16 and second arm 18 to be adjusted. In another embodiment, spring 44 can be biased such that lock 36 must be pushed to engage one or both of first arm 16 and second arm 18. Thus, one connection point is used to permit or to prohibit the movement of apparatus 10 in two directions, a vertical direction (first arm 16) and a horizontal direction (second arm 18).

Figure 8:
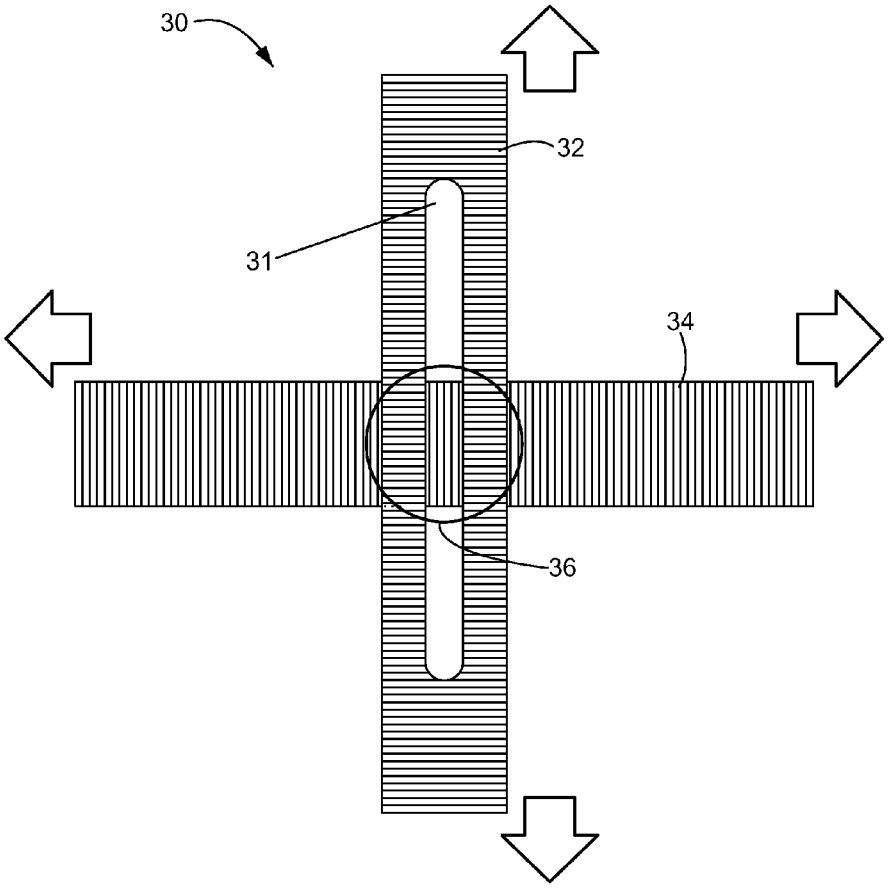
FIG. 8 is a view of the bidirectional track used with the adjustable product protection device of FIG. 1.

FIG. 8 shows bidirectional track 30 including vertical component 30*a* and horizontal component 30*b*. In one embodiment, vertical component 30*a* is disposed on the back of first arm 16 and horizontal component 30*b* is disposed on the back of second arm 18. In one embodiment, vertical component 30*a* and horizontal component 30*b* each include a series of teeth that are engaged with latch 46 (shown in FIG. 7) when latch 46 is projected forwarded into the path of first arm 16 and second arm 18. In particular, latch 46 removably engages second arm 18 through slot 31 and first arm 16 to retain the adjustable housing in a desired position. The teeth "catch" latch 46 thus locking into position first arm 16 or second arm 18. By applying a magnetic field from the magnet of a magnetic detacher upon lock 36, latch 46 is retracted in order to release both first arm 16 and second arm 18 (as also seen in FIG. 7). Once the magnetic detacher is removed, spring 44 urges latch 46 back into its original position which retains the positions of first arm 16 and second arm 18.

Figure 9:
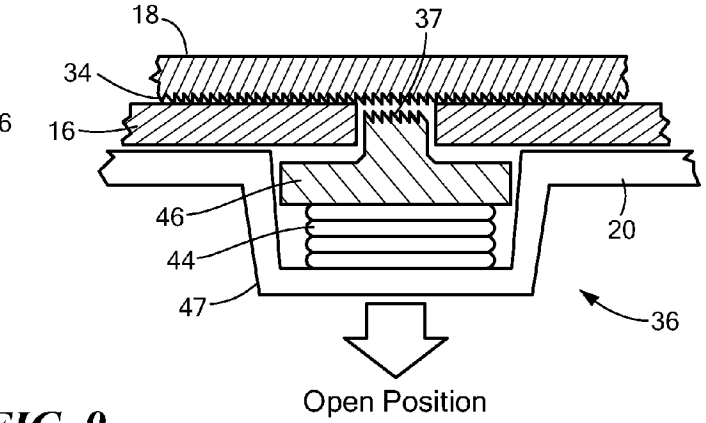
FIG. 9 is a close-up view of the locking mechanism of FIG. 7 in both a locked and an unlocked orientation.

FIG. 9 is a close-up view of lock 36 from FIG. 7 and illustrates the engagement of lock 36 with second arm 18. FIG. 9 depicts lock 36 in both a locked position and an open position. Lock 36 includes a recess 47 that retains spring 44 and latch 46. In one embodiment, recess 47 is formed as a part of third arm 20. In another embodiment, recess 47 is a separate component that interlocks with and protrudes from third arm 20. When lock 36 is in a locked position, spring 44 is biased such that it is compressed and spring 44 exerts a force against latch 46 urging latch 46 forward thus impeding the movement of first arm 16 and/or second arm 18. Latch 46 may include a plurality of teeth 37 on its upper portion such that when lock 36 is in a locked position, teeth 37 of latch 46 engage with the teeth 34 of second arm 18. This orientation is used when, for example, product 12 resides within apparatus 10 or when apparatus 10 is in storage in order to prevent unwanted movement of first arm 16 and second arm 18. When lock 36 is in an open position, spring 44 is compressed and latch 46 retracts thus allowing first arm 16 and second arm 18 to move in their respective direction. If latch 46 is a made of a ferrous material, lock 36 can be opened by a magnet applying a magnetic field upon latch 46. Thus, when a product 12 is brought to a POS, apparatus 10 is placed in a magnetic detacher which applies a magnetic field upon the ferrous material of latch 46, which attracts latch 46 thus compressing spring 44. This allows first arm 16 to be lifted and second arm 18 to be opened and product 12 removed from apparatus 10.

Figure 10:
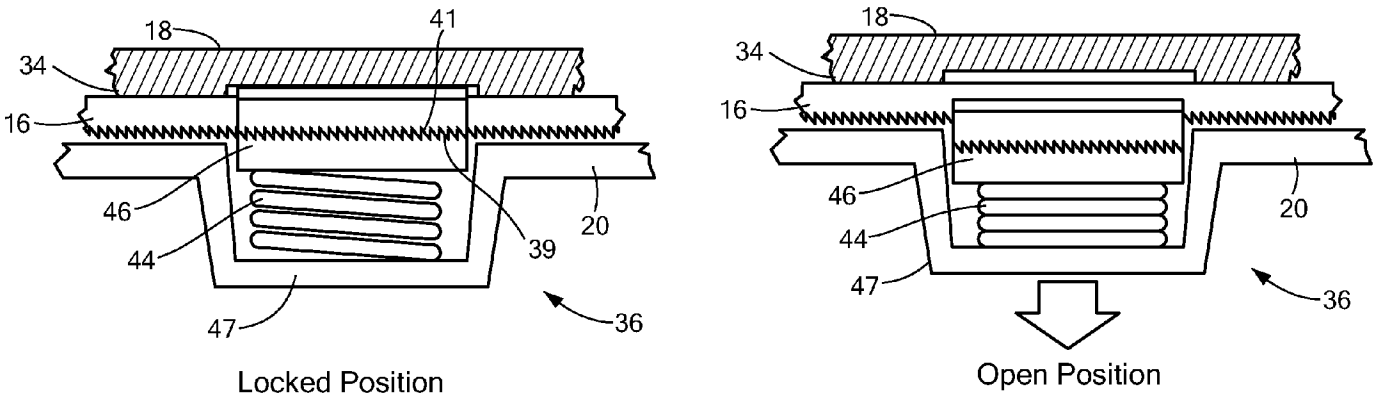
FIG. 10 is close-up view of the locking mechanism of FIG. 9 rotated 90 degrees.

FIG. 10 illustrates the interaction of lock 36 with first arm 16. The view in FIG. 10 is rotated 90 degrees from the view in FIG. 9 such that the engagement of latch 46 with first arm 16 can more easily be seen. In other words, the view in FIG. 9 is an enlarged view of lock 36 taken through section B-B in FIG. 6. Latch 36 includes a plurality of teeth 39 on its lower portion where the teeth engage a plurality of teeth 41 on first arm 16 when latch 46 is in a locked position. Thus, latch 46 includes a first plurality of teeth 37 on its upper portion that engage the teeth 34 on second arm 18 and a second plurality of teeth 39 on its lower section that engage the teeth 41 on first arm 16. Advantageously, the first plurality of teeth 37 on latch 46 are on a first plane and the second plurality of teeth 39 on latch 46 are on a second plane that is different from, but parallel to, the first plane. This allows the first plurality of teeth 37 to engage teeth 34 on second arm 18 preventing movement of second arm 18, and the second plurality of teeth 39 to simultaneously engage teeth 41 on first arm 16 preventing movement of first arm 16, when latch 46 is in the forward or "locked" position. In one embodiment, the first plurality of teeth 37 are situated in a first direction and the second plurality of teeth 39 are situated in a second direction, substantially 90 degrees in relation to the first direction.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A product protection apparatus comprising:

an adjustable housing, the housing being adjustable in a first direction, a second direction, a third direction and a fourth direction, the first direction opposite the second direction, and the third direction opposite the fourth direction, the housing including:

a first arm, the first arm defining a slot;

a second arm;

a third arm;

a first component, the first component allowing the housing to be adjusted in the first direction and the second direction; and a second component orthogonal to the first component, the second component allowing the housing to be adjusted in the third direction and the fourth direction; and a lock coupled to the third arm, the lock removably engaging the second arm through the slot to retain the adjustable housing in a desired position; and the first component and second component forming a bidirectional track in slidable engagement with the lock.

2. The apparatus of claim 1, wherein the first arm and the second arm each have a portion of the bidirectional track and are slidingly engageble with the third arm.

3. The apparatus of claim 1, wherein the lock includes a latch movable between a first position and a second position, the latch having a plurality of teeth, wherein the teeth are mated with the bidirectional track when in the first position and the teeth are retracted from the bidirectional track when in the second position.

4. The apparatus of claim 3, wherein the first component of the bidirectional track includes a plurality of teeth and the second component of the bidirectional track includes a plurality of teeth, the teeth of the latch engaged with the plurality of teeth on both the first component and the second component when the lock is in the first position.

5. The apparatus of claim 4, the latch having a first plane and a second plane, the second plane different from the first plane, each of the first plane and the second plane having a portion of the plurality of the teeth, the first plane being substantially parallel to the second plane.

6. The apparatus of claim 5, wherein the plurality of teeth on the latch are arranged in a first direction and a second direction, the plurality of teeth in the first direction engaging the plurality of teeth of the first component and the plurality of teeth in the second direction engaging the plurality of teeth in the second component when the lock is in the first position.

7. The apparatus of claim 5, wherein the plurality of teeth on the first plane of the latch are oriented at substantially a 90 degree angle to the plurality of teeth on the second plane of the latch.

8. The apparatus of claim 3, the lock further comprising a spring biased against the latch when the lock is in the first position thus preventing movement of the housing.

9. The apparatus of claim 8, the lock further comprising a recess, the recess being a part of the housing, wherein the spring and the latch are retained with the recess.

10. The apparatus of claim 3, wherein the latch is made of a metallic material and wherein the latch is moved to the second position by application of a magnetic field upon the latch.

11. The apparatus of claim 1, further comprising at least one of a radio frequency identification device, an electrical article surveillance tag, and an alarming device affixed to the housing.

12. A product protection apparatus comprising:

an adjustable housing, the housing comprising:

a first arm, the first arm defining a slot;

a second arm; and a third arm, the first arm configured to move in a first direction and a second direction with respect to the third arm and the second arm configured to move in a third direction and a fourth direction with respect to the third arm, the first direction being opposite the second direction, and the third direction being opposite the fourth direction;

a first component, the first component allowing the housing to be adjusted in the first direction and the second direction; and a second component orthogonal to the first component, the second component allowing the housing to be adjusted in the third direction and the fourth direction; and a lock being coupled to the third arm, the lock removably engaging the second arm through the slot to retain the adjustable housing in a desired position; and the first component and second component forming a bidirectional track in slidable engagement with the lock.

13. The apparatus of claim 12, wherein the first arm and the second arm each have a portion of the bidirectional track and are slidingly engageble with the third arm.

14. The apparatus of claim 12, wherein the lock includes a latch movable between a first position and a second position, the latch having a plurality of teeth, wherein the teeth are mated with the bidirectional track when in the first position and the teeth are retracted from the bidirectional track when in the second position.

15. The apparatus of claim 14, wherein the first component of the bidirectional track includes a plurality of teeth and the second component of the bidirectional track includes a plurality of teeth, the teeth of the latch engaged with the plurality of teeth on both the first component and the second component when the lock is in the first position.

16. The apparatus of claim 15, the latch having a first plane and a second plane, the second plane different from the first plane, each of the first plane and the second plane having a portion of the plurality of the teeth, the first plane being substantially parallel to the second plane.

17. The apparatus of claim 16, wherein the plurality of teeth on the latch are arranged in a first direction and a second direction, the plurality of teeth in the first direction engaging the plurality of teeth of the first component and the plurality of teeth in the second direction engaging the plurality of teeth in the second component when the lock is in the first position.

18. A method of securing a product within an adjustable housing, the method comprising:

inserting a product within an adjustable housing, the housing adjustable in a first direction, a second direction, a third direction and a fourth direction, the first direction being opposite the second direction, and the third direction being opposite the fourth direction;

adjusting the housing in one or more of the first direction, the second direction, the third direction and the fourth direction in order to secure the product; and using a lock to maintain the housing in the adjusted position, the lock including a latch having a first plane and a second plane, the second plane different from the first plane, each of the first plane and the second plane having a plurality of teeth, the first plane being substantially parallel to the second plane.

* * * * *